US007232417B2

(12) United States Patent
Plante

(10) Patent No.: US 7,232,417 B2
(45) Date of Patent: Jun. 19, 2007

(54) ACOUSTIC THERAPEUTIC DEVICE AND METHOD FOR TREATING CYSTIC FIBROSIS AND OTHER RESPIRATORY PATHOLOGIES

(75) Inventor: Louis Plante, Roch Forest (CA)

(73) Assignee: Dymedso Inc. (CA)

( * ) Notice: Subject to any disclaimer, the term of this patent is extended or adjusted under 35 U.S.C. 154(b) by 0 days.

(21) Appl. No.: 10/712,749

(22) Filed: Nov. 13, 2003

(65) Prior Publication Data

US 2004/0097850 A1 May 20, 2004

Related U.S. Application Data

(60) Provisional application No. 60/425,962, filed on Nov. 13, 2002.

(51) Int. Cl.
*A61H 1/00* (2006.01)

(52) U.S. Cl. ..... 601/46; 601/150

(58) Field of Classification Search ..... 601/48–49, 601/55–56, 77, 148–152, 46; 128/DIG. 20; 5/453, 915
See application file for complete search history.

(56) References Cited

U.S. PATENT DOCUMENTS 4,064,376 A 12/1977 Yamada
4,216,766 A * 8/1980 Duykers et al. ..... 600/586
RE32,785 E 11/1988 Hirano
5,101,810 A 4/1992 Skille et al.
5,113,852 A 5/1992 Murtonen
5,453,081 A * 9/1995 Hansen ..... 601/150
5,829,429 A 11/1998 Hughes
5,893,361 A 4/1999 Hughes
6,167,881 B1 1/2001 Hughes
6,193,677 B1 2/2001 Cady
6,974,425 B2 * 12/2005 Rogers et al. ..... 601/46
2002/0014235 A1 * 2/2002 Rogers et al. ..... 128/200.24

* cited by examiner

*Primary Examiner*—Michael A. Brown

(74) *Attorney, Agent, or Firm*—Quarles & Brady

(57) ABSTRACT

The present invention discloses a device and method for promoting the expectoration of secretions from a patient's lungs, the method comprising the application of acoustic waves to the chest cavity of the patient through a transducer coupled to an acoustic coupling chamber, the acoustic coupling chamber being positioned adjacent an overlaying skin surface wherein the acoustic waves are of a frequency in a range of about 30 Hertz to about 120 Hertz.

23 Claims, 4 Drawing Sheets

ACOUSTIC THERAPEUTIC DEVICE AND METHOD FOR TREATING CYSTIC FIBROSIS AND OTHER RESPIRATORY PATHOLOGIES

CROSS-REFERENCE TO RELATED APPLICATIONS

The present application claims the benefits of U.S. Provisional patent application No. 60/425,962 filed Nov. 13, 2002, which is hereby incorporated by reference.

TECHNICAL FIELD

The present invention relates generally to a device and method for treating cystic fibrosis and other respiratory pathologies.

BACKGROUND

Cystic fibrosis is the most common fatal hereditary, single gene disease in North America and Europe. The average age of patients with cystic fibrosis at the time of their death is currently about 36 years old. Most of the morbidity and almost all of the mortality is associated with respiratory lung disease characterized by obstruction of the bronchial tubes by abundant thick infected mucus.

The basic defect in cystic fibrosis is a deficiency in the function of the protein known as the cystic fibrosis transmembrane conductance regulator (CFTR). CFTR is an anion channel allowing the passage of salt, bicarbonate and other negatively charged substances across the apical membranes of epithelial cells in the airways, pancreas, liver, intestinal tract and reproductive system. The absence of CFTR in cystic fibrosis epithelia leads to a marked decrease of water and salt secretion which results in a characteristic increase in the viscosity of secretions. These secretions bind to the walls of the bronchial tubes and form tenacious plaques that cannot be carried up to the throat by cilia that line the airways. Subsequently, inhaled bacteria become trapped in these secretions (or mucus), proliferate and initiate a cycle of events including airway tissue destruction, airway inflammation and the accumulation of even greater amounts of thick, adherent mucus. All of these events, which eventually lead to respiratory insufficiency and death, are initiated by the lung's inability in the absence of CFTR to clear the viscous mucus from the airways. Correction of this basic defect in airway clearance is the goal of many therapeutic developments aiming to control or cure cystic fibrosis.

While defective mucociliary clearance is most obvious in patients with cystic fibrosis, many more patients suffering from common respiratory ailments such as chronic bronchitis, bronchiectasis, asthma, muscular dystrophy, neuromuscular degenerative disorders, post-operative atelectasis and thoracic wall defects are also afflicted by their incapacity to adequately clear their airways of abundant mucus. Consequently, these patients are at high risk of presenting multiple lung infections. They require frequent use of antibiotics and medical services, as well as repeated hospitalizations. Improved clearance of thick respiratory secretions in all of these medical conditions is a fundamental objective of current therapeutic approaches.

The cornerstone of therapy for cystic fibrosis and other respiratory ailments involving inspissated mucus is chest physiotherapy aimed at moving the bronchial secretions up towards the throat. Several respiratory physiotherapy approaches have been developed to address the problem of therapeutic airway clearance. The best known technique of airway clearance against which other methods are compared remains postural drainage with clapping. This technique necessarily requires a therapist, often a family member, who repeatedly claps the chest wall of the patient with an open hand while the patient is positioned in such a way that the bronchial tube being drained is inclined at an angle favoring movement of mucus down a slope. The patient's position is changed periodically to allow all major bronchial tubes to be treated. Because the technique requires the help of a therapist and because the positions and clapping are uncomfortable procedures, patients most often abandon such potentially important therapy during adolescence.

Since airway clearance is such an important part of the management of respiratory diseases with thick mucus, several alternative techniques have been developed to improve compliance. Among these techniques are the following:

- Autogenic drainage is a technique in which a superficial breathing pattern at low lung volumes is followed by huffing or forced expiratory bursts to move the mucus towards the throat and provoke a cough with expectoration.
- PEP mask is a technique in which a positive expiratory pressure is applied to the mouth with a mask during exhalation in an attempt to maintain the bronchial tubes open as the air is exiting the lungs. This allows mucus to be displaced more effectively than with simple cough.
- Flutter is a simple device into which patients blow slowly and which creates a positive expiratory pressure much like the PEP mask. However, in addition, the Flutter creates a mild vibration at the mouth allowing adherent mucus to more readily be dislodged from the bronchial tubes.
- The mechanical percussor is an electrical device based along the same principles as postural drainage with clapping, but the major advantage is that the patient can perform the treatments alone without the need of a therapist. However, the technique is awkward since certain areas of the chest are more difficult to reach. Additionally, the technique is uncomfortable since the percussion is repeated over a diseased chest.
- The pneumatic vest is an inflatable vest connected to a pneumatic compressor allowing repeated mechanical compressions of the thorax at high frequencies.

Very little data exists comparing the effectiveness of these airway clearance techniques to postural drainage with clapping, and none have proven to be more effective. The most significant advantage of these alternative chest physiotherapy techniques is the autonomy it gives to patients since they do not require a therapist. However, it has been found that the majority of patients use these techniques only sporadically, and sometimes stop them altogether, since they are unable to mobilize significant amounts of mucus and do not feel any benefits.

A real need, therefore, exists for improved airway clearance techniques that will be effective and favor patient compliance. Accordingly, it is an object of the present application to obviate or mitigate some or all of the above disadvantages.

SUMMARY

In one aspect of the present invention, there is provided a method for promoting the expectoration of secretions from a patient's lungs, the method comprising the application of acoustic waves to the chest cavity of the patient through an acoustic transducer coupled to an acoustic coupling chamber, the acoustic coupling chamber being positioned adjacent an overlaying skin surface wherein the acoustic waves are of a frequency in a range of about 30 Hertz to about 120 Hertz.

In another aspect of the present invention, there is further provided a device for assisting a patient in promoting the expectoration of secretions from the lungs. This device comprises:

a signal generator for generating an electrical signal;

an amplifier for amplifying the electrical signal;

an acoustic transducer for converting the amplified electrical signal into an acoustic wave; and an acoustic coupling chamber coupled to the acoustic transducer, such that when the device is in use, the acoustic coupling chamber is positioned adjacent an overlaying skin surface;

wherein the acoustic waves are applied to the chest cavity of the patient through the acoustic coupling chamber and the acoustic waves have a frequency in a range of about 30 Hertz to about 120 Hertz.

BRIEF DESCRIPTION OF THE FIGURES

Embodiments of the invention will be described by way of example only with the help of the accompanying figures.

DETAILED DESCRIPTION

Figure 1:
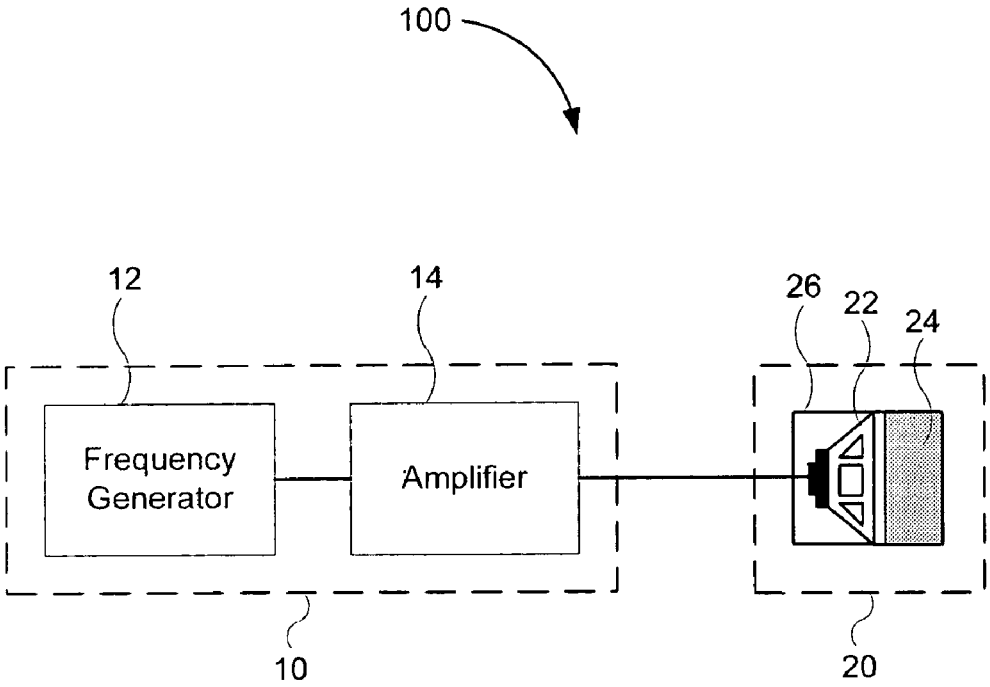
FIG. 1 is a block diagram of a device for treating cystic fibrosis and other respiratory pathologies.

An embodiment of a device (100) for treating cystic fibrosis and other respiratory pathologies is shown in FIG. 1. The device (100) comprises a main unit (10) including an adjustable frequency generator (12) and an adjustable amplifier (14), and a treatment interface (20) including an acoustic transducer (22) coupled to an acoustic coupling chamber (24) and casing (26). Frequency generator (12) and amplifier (14) are used to provide an electrical signal to acoustic transducer (22), which can be a loudspeaker, for example. Advantageously, acoustic coupling chamber (24) is detachably coupled to acoustic transducer (22) and is composed of a material which may be sterilized.

In use, the frequency generator (12) generates signals preferably at a frequency of between about 30 Hertz and about 120 Hertz. In one embodiment of the present invention, the frequency of signals is between about 30 Hertz and about 70 Hertz. Furthermore, the generated frequencies are ideally pure sinusoid waves. Alternately, the signal may be generated as a pulse having a duration of 0.5 seconds at a repetition of once every second. The signal is amplified by amplifier (14), transformed by acoustic transducer (22) into an acoustic wave having an amplitude of between about 10 Watts and about 50 Watts, which wave is propagated to a patient by applying the acoustic coupling chamber (24) to the chest wall of the patient. The acoustic coupling chamber (24) follows the general contour of acoustic transducer (22) and creates a gap of approximately 1 to 2 inches in between the transducer (22) and the chest wall of the patient, thus preventing the direct contact of the acoustic transducer (22) with the skin. The size of the gap may be varied with the type of acoustic transducer (22) selected. The exact frequency of the acoustic waves and their amplitude may also be varied according to the selected site on the thorax as well as the patient's condition and body structure, and may be adjusted by the patient according to his reaction to the effects of the waves. The low frequency acoustic waves propagate through the chest wall without inducing pain. The excitation of the bronchial walls by the propagated waves dislodges viscous mucus or bronchial secretions so as to reactivate the normal beats of the pulmonary cilia, helping the secretions follow their natural path. This eventually induces cough and then expectoration of the secretions. The duration of the application of the above described treatment to the patient generally varies between approximately 20 to 30 minutes, depending on the selected site on the thorax as well as the patient's condition and body structure, and may be adjusted by the patient according to his reaction to the effects of the waves.

Figure 2:
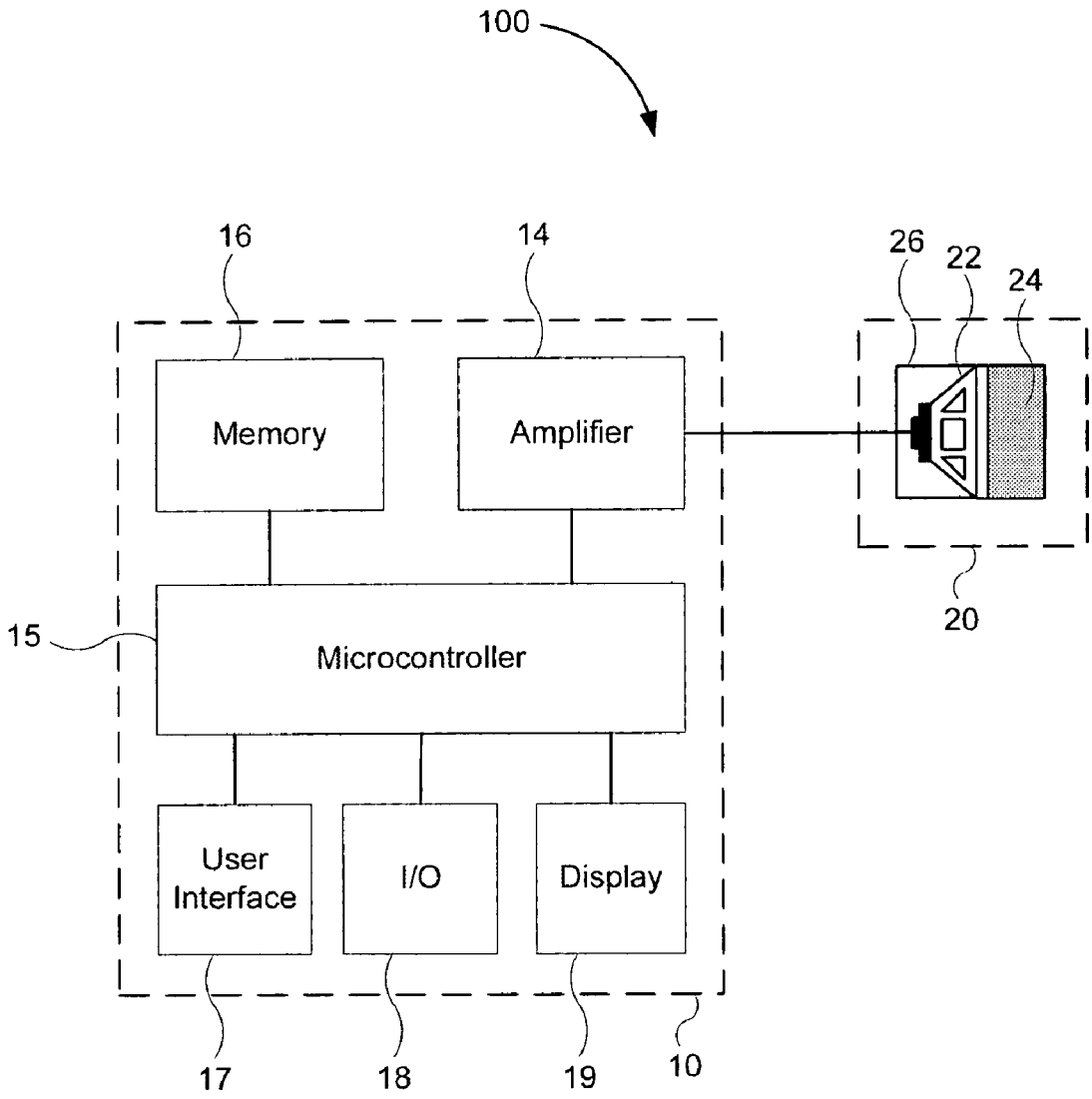
FIG. 2 is a block diagram of an alternative embodiment of the device of FIG. 1.

FIG. 2 shows an alternate embodiment of device (100). This embodiment is similar to the previous one but uses a microcontroller (15) with associated memory (16) to digitally generate the electrical signals, which are then converted into analog signals and provided to amplifier (14). The patient or the therapist communicates with the device (100) using a user interface (17), such as, for example, a keypad or keyboard. An optional display unit (19), such as, for example, a LCD, may be provided to display information, for example the remaining time or any other relevant information. Furthermore, the memory (16) may be used by the microcontroller (15) to store historical data on the frequencies, amplitudes, duration, time and date of each individual treatment sessions, and may be transferred to, for example, a portable computer or any other such device, via Input/Output (18).

Figure 3:
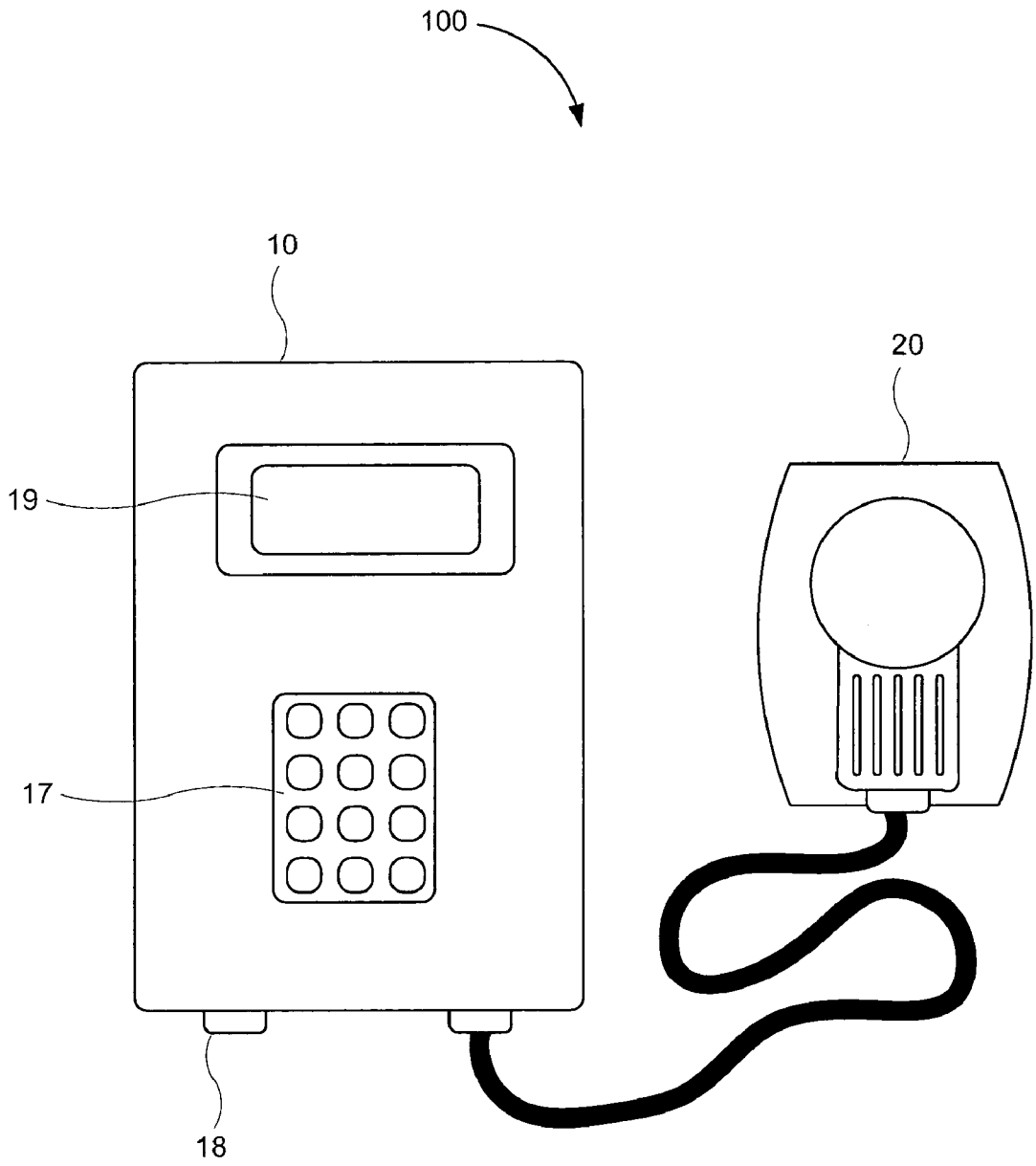
FIG. 3 is a pictorial view of the device of FIG. 1 or 2.
Figure 4:
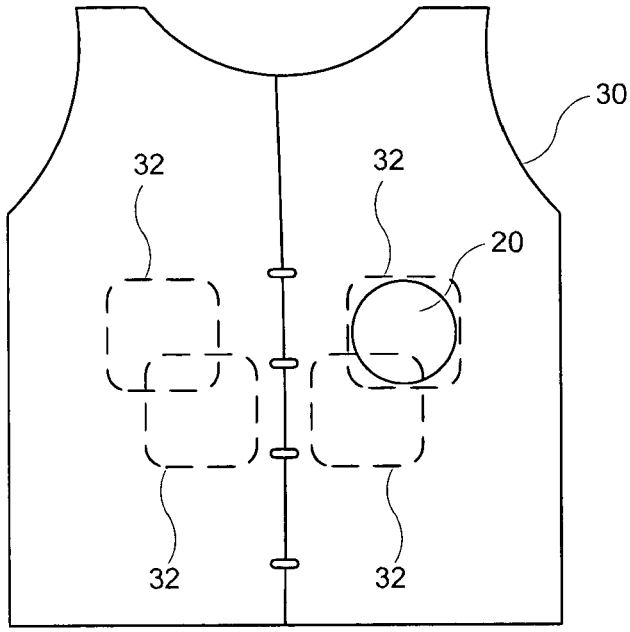
FIG. 4 is a pictorial view of the placement of a treatment interface.
Figure 5:
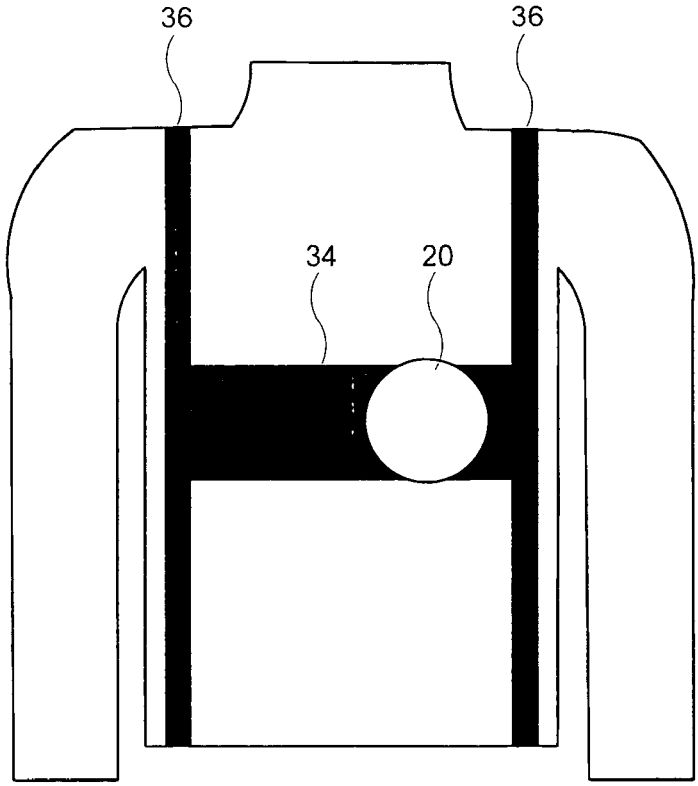
FIG. 5 is a pictorial view of an alternative embodiment of FIG. 4.

In a particular embodiment, illustrated in FIG. 3, the treatment interface (20) may be designed as to be handheld, making device (100) advantageously small enough to be easily carried. In another embodiment, the treatment interface (20) may be placed in specifically positioned pockets (32) on a vest (30) or other clothing apparel, such as illustrated in FIG. 4. In a further embodiment, the treatment interface (20) may be held by some sort of support about the chest of the patient, for example an elastic band (34) held by suspenders (36) and placed across the torso of the patient, such as illustrated in FIG. 5.

EXAMPLE

In a sample application, referring to FIG. 2, the main unit (10) includes a SBC0386EX microcontroller (15) from Micro/Sys®, Flash memory (16), keypad (17), RS-232 interface (18), LCD display (19) and an audio amplifier (14). The treatment interface (20) includes a 3.5 inch woofer model RS400 acoustic transducer (22) from Bazooka® and an acoustic coupling chamber (24) creating a gap of about 1.5 inches between the acoustic transducer (22) and the chest wall of the patient. Microcontroller (15) digitally generates a sinusoidal electrical signal, which is converted into an analog signal by the microcontroller's (15) internal Digital to Analog Converter (DAC) and then provided to audio amplifier (14). The amplifier (14) then feeds the treatment interface (20), which is applied to the patient.

Although the present invention has been described by way of particular embodiments and examples thereof, it should be noted that it will be apparent to persons skilled in the art that modifications may be applied to the present particular embodiment without departing from the scope of the present invention.

What is claimed is:

1. A device for assisting a patient in promoting the expectoration of secretions from the lungs, said device comprising:

a main unit including:

a microcontroller for generating digital electrical signals;

a user interface for adjusting the frequency of said digital electrical signals;

a Digital to Analog Converter for converting said digital electrical signals into analog signals an adjustable amplifier for amplifying said analog signals;

a treatment interface operatively connected to the main unit, including:

an acoustic transducer for converting said amplified analog signal into acoustic waves; and an acoustic coupling chamber coupled to said acoustic transducer, said acoustic coupling chamber creating an enclosed gap between said acoustic transducer and an overlaying skin surface of said patient when said treatment interface is applied to a chest cavity of said patient;

wherein said digital electrical signals have a frequency located in a range of about 30 Hertz to about 120 Hertz and said analog signals have a power located in a range of about 10 Watts to about 50 Watts to efficiently promote the expectoration of secretions from the lungs of said patient.

2. A device as defined in claim 1, wherein said digital electrical signals have a frequency located in a range of about 30 Hertz to about 70 Hertz.

3. A device as defined in claim 1, wherein said digital electrical signals are sinusoidal.

4. A device as defined in claim 1, wherein said digital electrical signals are pulses having a duration of 0.5 seconds at a repetition of once every second.

5. A device as defined in claim 1, wherein said enclosed air gap is in a range of about 1 to 2 inches.

6. A device as defined in claim 1, wherein said acoustic coupling chamber is detachably coupled to said acoustic transducer.

7. A device as defined in claim 1, wherein said acoustic coupling chamber is composed of a sterilizable material.

8. A device as defined in claim 1, wherein said acoustic transducer has a diameter in a range of about 3 to 6 inches.

9. A device as defined in claim 1, wherein said acoustic transducer includes a support member.

10. A device as defined in claim 1, wherein said user interface is a keypad.

11. A device as defined in claim 1, wherein said user interface is a keyboard.

12. A device as defined in claim 1, further comprising a display unit operatively connected to the microcontroller.

13. A device as defined in claim 12, wherein said display unit is a LCD.

14. A device as defined in claim 1, further comprising an input/output operatively connected to said microcontroller.

15. A device for assisting a patient in promoting the expectoration of secretions from the lungs, said device comprising:

a main unit including:

an adjustable frequency generator for generating electrical signals;

an adjustable amplifier for amplifying said electrical signals;

a treatment interface operatively connected to the main unit, including:

an acoustic transducer for converting said amplified electrical signals into acoustic waves; and an acoustic coupling chamber coupled to said acoustic transducer, said acoustic coupling chamber creating an enclosed air gap between said acoustic transducer and an overlaying skin surface of said patient when said treatment interface is applied to a chest cavity of said patient;

wherein said electrical signals have a frequency located in a range of about 30 Hertz to about 120 Hertz and said amplified electrical signals have a power located in a range of about 10 Watts to about 50 Watts to efficiently promote the expectoration of secretions from the lungs of said patient.

16. A device as defined in claim 15, wherein said electrical signals have a frequency located in a range of about 30 Hertz to about 70 Hertz.

17. A device as defined in claim 15, wherein said electrical signals are sinusoidal.

18. A device as defined in claim 15, wherein said electrical signals are pulses having a duration of 0.5 seconds at a repetition of once every second.

19. A device as defined in claim 15, wherein said enclosed air gap is in a range of about 1 to 2 inches.

20. A device as defined in claim 15, wherein said acoustic coupling chamber is detachably coupled to said acoustic transducer.

21. The device as defined in claim 15, wherein said acoustic coupling chamber is composed of a sterilizable material.

22. The device as defined in claim 15, wherein said acoustic transducer has a diameter in a range of about 3 to 6 inches.

23. The device as defined in claim 15, wherein said acoustic transducer includes a support member.

* * * * *